United States Patent [19]

Distasio

[11] Patent Number: 4,796,734

[45] Date of Patent: Jan. 10, 1989

[54] TOTEABLE SHADED HEADREST

[76] Inventor: Shawn M. Distasio, P.O. Box 60794, Sacramento, Calif. 95860-0794

[21] Appl. No.: 166,629

[22] Filed: Mar. 11, 1988

[51] Int. Cl.[4] ..... A45C 3/10

[52] U.S. Cl. ..... 190/1; 190/2; 135/95; 383/4

[58] Field of Search ..... 190/1,2; 383/4; 135/95

[56] References Cited

U.S. PATENT DOCUMENTS

| | | | |
|---|---|---|---|
| 2,070,484 | 2/1937 | Jones | 190/1 X |
| 2,543,597 | 2/1951 | Peery | 135/95 |
| 2,584,432 | 2/1952 | De Marco | 190/1 X |
| 2,819,776 | 1/1958 | Balsam | 190/1 |
| 3,298,477 | 1/1967 | Martinez | 190/1 |
| 3,651,847 | 3/1972 | Casamassima | 190/1 X |
| 4,180,112 | 12/1979 | Bovet | 190/1 X |

FOREIGN PATENT DOCUMENTS

| | | | |
|---|---|---|---|
| 143163 | 10/1935 | Austria | 190/2 |
| 986147 | 7/1951 | France | 190/1 |
| 1012830 | 4/1952 | France | 190/1 |
| 379524 | 3/1940 | Italy | 135/95 |
| 171904 | 12/1934 | Switzerland | 190/1 |
| 348821 | 5/1931 | United Kingdom | 190/1 |

*Primary Examiner*—William Price

[57] ABSTRACT

A cloth covered framework is structured in three panel sections hingedly attached to provide a shaded head rest for human use. The three panels include a horizontally positioned base panel on which the head is rested, a vertical header panel which supports a shade panel hingedly arranged for positioned in parallel alignment with the base panel as a sun shade. There are capped pockets on the outer surfaces of the panels and the framework can be folded up into a carrying package. The shade panel has side flaps for additional shading and as a retainer for the folded framework. Handles for carrying and fasteners for the side flaps as a retainer are provided.

5 Claims, 2 Drawing Sheets

TOTEABLE SHADED HEADREST

BACKGROUND OF THE INVENTION

1. Field of the Invention:

This invention relates to portable shades and headrests. The present invention is particularly directed towards a shade and headrest combination with adjustable panels which can be positioned to shade the head of the user.

2. Description of the Prior Art:

In the past art patents examined, there are few devises designed as both a headrest and a sunshade. Most of the patents considered pertinent to the present invention were fold-up cushion devices with carrying structure for portability. The exception is U.S. Pat. No. 2,070,484, issued to N. M. Jones on Feb. 9, 1937. The Jones device is a foldable headrest with a fringed shade. Mechanics for adjusting the device and repositioning the shade during use are missing. Although frictional tightening of the pivotal joints for preventing accidental displacement of the frames is mentioned, no adjusting means is illustrated or described for the purpose of repositioning the shade. This shortcoming is eliminated in my design by use of adjustable cone hinges.

Other patents seen and considered interesting but not necessarily pertinent to the present invention include the U.S. Pat. No. 2,771,125, issued to A. L Dobbins, dated Nov. 20, 1956, which uses extensive framework to support a foldable canopy, and the J. L. De Souza Filho device, U.S. Pat. No. 3,404,915, issued Oct. 8, 1968, for a beach chair and cot.

Patents illustrating foldable seats and pads included the cushion of Moto Iwata, dated Apr. 29, 1975, U.S. Pat. No. 3,879,775, the multi-purpose bag shown by Jill A. Sneider, in U.S. Pat. No. 4,154,323, of May 15, 1979; and the cushion and carrying case of Glen M. Harvell, U.S. Pat. No. 4,190,918, dated Mar. 4, 1980. Tote bag and body rest devices are shown in the Kathleen F. Yellin U.S. Pat. No. 4,194,601, issued on Mar. 25, 1980, and in U.S. Pat. No. 4,194,517, dated Aug. 21, 1984, granted to the same inventor, Yellin, for a top opening tote bag body rest.

There were no devices seen in the past art patents examined which were so similar in nature to my invention as to discourage further prosecuting my application on the present invention.

SUMMARY OF THE INVENTION

My invention is structured in the form of a tote bag which converts into a shaded headrest. By affixing a light-weight, cloth covered frame with adjustable cone-type contact hinges, I provide a headrest with a foldable shade which can be adjusted to a desired position for protection from direct sunlight. After use, the present invention can be folded back into a tote bag with a handle or a shoulder strap for carrying. The folded unit provides a convenient container for the user's personal items in the bag and in a variety of attached pockets.

Therefore, a primary object of my invention is to provide a sunshade which is one in part with a functional tote bag.

Another object of the invention is to provide a tote bag which can be unfolded and is useful as a headrest which includes an adjustable sunshade.

A still further object of the present invention is to provide a cloth covered frame with cone-shaped hinges which firmly retain the rigidity of the structure, can be hand-adjusted for repositioning the sunshade, and hand-released for folding the structure into a carrying unit.

Other objects and the many advantages of my invention will become better understood by reading the specifications and comparing the numbered parts therein with similar numbered parts shown on the included drawings.

Figure 1:
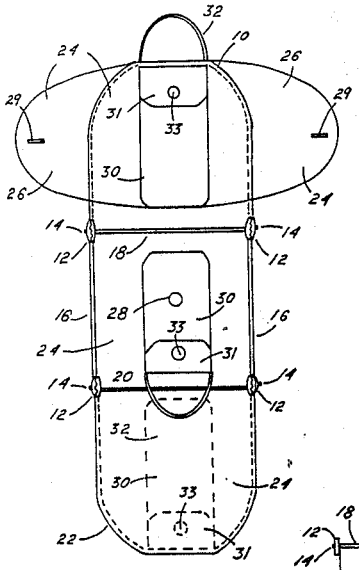
FIG. 1 is a top plan view of the toteable shaded headrest with the panels laid in a flat position.

DRAWING REFERENCE NUMERALS 10 top frame shade panel
12 adjustable retention hinge
14 hinge adjust cap nut
16 vertical frame support panel
18 top horizontal support shaft
20 bottom horizontal support shaft
22 bottom frame base panel
24 cloth covering
26 shade flaps
28 shade flaps retainer button
29 shade flaps button holes
30 utility pockets
31 utility pocket cap
32 carry handle
33 pocket cap retainer buttons
34 shade frame shapes
36 outer hinge disc
38 inner hinge disc
40 disc knurled contact surface
42 outer hinge disc shade frame attach fitting
44 inner hinge disc support frame attach fitting
46 disc hinge shaft aperture
48 compression spring washer
50 compression spring washer hinge disc recess
52 threaded hinge adjust shaft
54 shaft hinge housing stops
55 velcro fasteners
56 illustrative user

DESCRIPTION OF THE PREFERRED EMBODIMENTS

Referring to the drawings at FIG. 1 showing my toteable shaded headrest opened and laid out in a top plan view. Upwardly in the FIG. 1 view, top frame of shade panel 10 forms the outline of the basic cover seen under cloth covering 24 at the curving spaced lines indicating stitching. Carrying handle 32 is uppermost in the illustration and capped utility pocket 30 is affixed substantially centrally outerfaced on cloth covering 24 in top shade panel 10 and in vertical panel 16. Pocket 30 is indicated by dotted lines underneath in base panel 22. Shade flaps 26 are lateral extensions of cloth covering 24 affixed in T-fashion across top shade panel 10 as illustrated in FIG. 1. The utility pocket 30 is useful in the three positions illustrated in FIG. 1 and the embodiment shown utilizes retainer buttons 33 for buttoning down the cap 31 of utility pocket 30. Shade flap retainer buttons 28 are for buttoning shade flaps 26 around the folded structure of the headrest as illustrated at F in FIG. 2. As the toteable shaded headrest is laid out in FIG. 1, top frame shade panel 10 is affixed by friction hinge 12 to vertical frame support panel 16. Further down in the illustration, frame support panel 16 is affixed by friction hinge 12 to bottom frame base panel 22. Friction hinge 12 has a hinge adjust cap nut 14 which can be tightened or loosened on the threaded ends of both top horizontal support shaft 18 and bottom horizontal support shaft 20 so the frames of the device can be loosened and tightened to retain useful positions when the structure is used as a headrest and sunshade.

Figure 2:
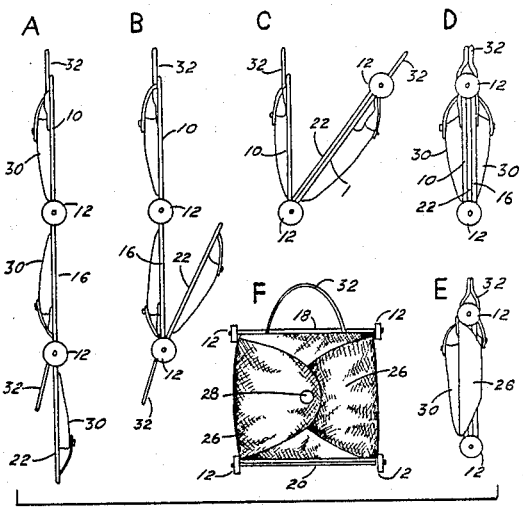
FIG. 2 is a side view of the invention illustrating the folding up steps at A, B, C, D, E, and F with F being a frontal view of the folded unit ready for carrying.
Figure 3:
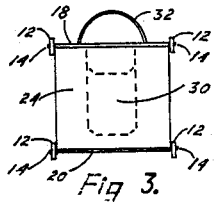
FIG. 3 illustrates the vertical frame support panel in a rear view.

The foldability of this invention is best illustrated in FIG. 2 which shows the structure of FIG. 1 in reduced size side views to illustrate folding mechanics. FIG. 2 at A shows the device of FIG. 1 fully extended vertically with top frame shade panel 10 at the top and bottom frame base panel 22 at the bottom. Adjustable retention hinges 12 are shown attaching top frame shade panel 10, vertical frame support panel 16, and bottom frame base panel 22. At B in FIG. 2, bottom frame base panel 22 is shown folded upwardly and half of carry handle 32 is now the lowest part. At C in FIG. 2, vertical frame support panel 16 and bottom frame base panel 22 have been folded upward and are now in parallel alignment ready for the final fold. The two sections of carry handle 32 are in the uppermost position. In FIG. 2 at D, top frame shade panel 10, vertical frame support panel 16, and bottom frame base panel 22 are folded vertically and the two halves of carry handle 32 are together as a single carrying handle. At E in FIG. 2, shade flaps 26 are wrapped around securing the vertically folded frame of the invention. Capped utility pocket 30 is shown to the left in the illustration. Handle 32 is at the top above the upper adjustable retention hinge 12 and the entire structure is resting on the downwardly positioned adjustable retention hinge 12. In FIG. 2 at F, the folded toteable shaded headrest is illustrated from the shade flaps 26 retainer side. Top horizontal support shaft 18 is shown upwardly below handle 32 and bottom horizontal support shaft 20 is shown positioned downwardly. Adjustable retention hinges 12 can be seen at the ends of top horizontal support shaft 18 and bottom horizontal support shaft 20. Shade flaps 26 are illustrated attached by shade flaps retainer button 28. In the open line drawing at FIG. 3, the relationship of top horizontal support shaft 18 and bottom horizontal support shaft 20 to adjustable retention hinges 12 as axle shafts is shown. In the illustration at FIG. 3, the position of the hinge adjust cap nut 14 on adjustable retention hinge 12 is shown.

Figure 4:
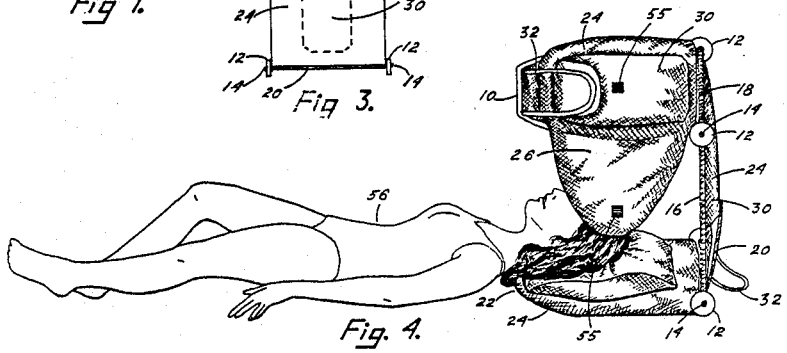
FIG. 4 shows the shaded headrest in use with the flaps down as further shading devices.
Figure 5:
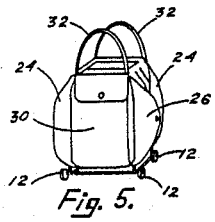
FIG. 5 shows the toteable shaded headrest folded up and the pocket filled for use.
Figure 6:
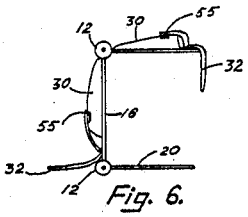
FIG. 6 is a side view of the shaded headrest unfolded and positioned for use.
Figure 7:
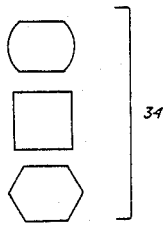
FIG. 7 illustrates various patterns that the design of this invention may assume.

A three-fold embodiment of the invention is illustrated in FIG. 5. Handle halves 32 are at the extreme ends of top frame shade panel 10 and bottom frame base panel 22 in the FIG. 5 illustration. The adjustable retainer hinges 12 are in parallel horizontal alignment and downwardly positioned as a base for the folded shade structure. The toteable shaded headrest opened and in use is illustrated in the perspective view at FIG. 4. Top frame shade panel 10 is in an upward horizontal position. Vertical frame support panel 16, right in the illustration, affixed by adjustable retention hinges 12 to bottom frame base panel 22 as a base, holds top frame shade panel 10 positioned above the head of illustrative user 56. Cloth covering 24 encasing the framework acts as the shading medium. For side shading, shade flaps 26 are let down as shown in FIG. 4. The upper half of handle 32 is laid back on top positioned utility pocket 30 and velcro fasteners 55 are shown as shade flap retainers in place of shade flap retainer buttons 28. Although not visible, utility pouch cap 31 is also retained by velcro fittings. For the use illustrated in FIG. 4, adjustable retention hinge 12 is positioned by illustrative user 56 as desired and by tightening hinge adjust cap nuts 14, the shade is retained in position for use. FIG. 6 is a line drawing of FIG. 4 in a reversed side view. FIG. 7 illustrates various shapes which the shade frame of the invention can be supplied in.

Figure 8:
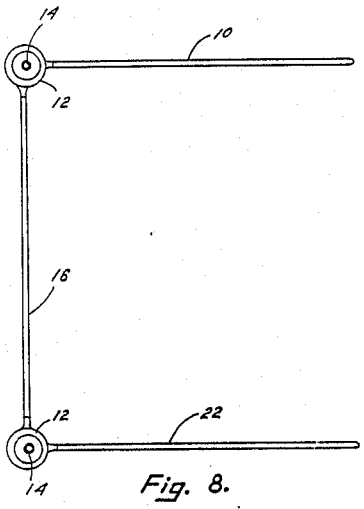
FIG. 8 is a side view of the internal framework showing the corner-attach adjustable hinging.
Figure 9:
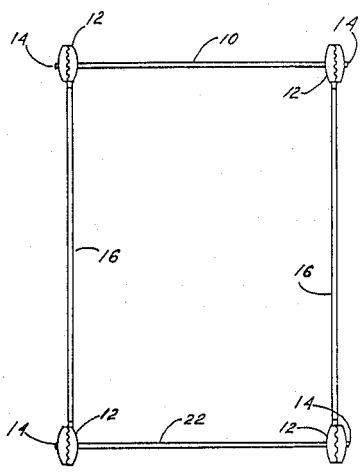
FIG. 9 shows the frame structure in a frontal view.
Figure 10:
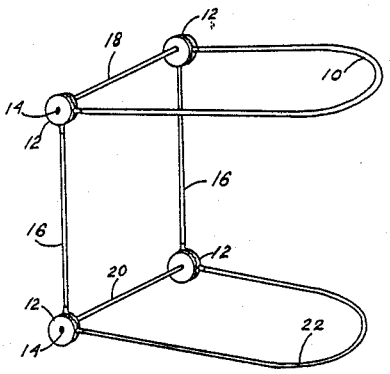
FIG. 10 is a perspective drawing of the framing structure and adjustable hinge arrangement.

FIGS. 8, 9, and 10 in the drawings illustrate the frame and hinge structure of this invention. Although the top and bottom framework is obviously reversible, the frame structure as positioned in the drawings includes top shade frame 10 in the uppermost position, vertical support frame 16 upright left in the drawing, and base frame 22 downwardldy positioned as a support stand for the entire framework. Two of the four adjustable retention hinges can be seen with an upwardly adjustable retention hinge 12 and a downwardly adjustable retention hinge 12 shown. The hinge adjust cap nut 14 can be seen in the center of the two adjustable retention hinges 12. Hinge adjust cap nut 14 can be seen in the center of the two adjustable retention hinges 12. Hinge adjust cap nut 14 is arranged for easy manual manipulation and can best be seen in FIGS. 11 and FIG. 12. The four adjustable retention hinges 12, the axle-type top horizontal support shaft 18, and the bottom horizontal support shaft 20 are best seen in, FIG. 10. FIG. 9 is a frontal view of FIG. 8.

Figure 11:
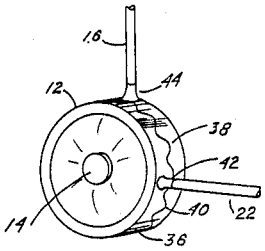
FIG. 11 is an enlargement of one of the corner-attached adjustable hinges.
Figure 12:
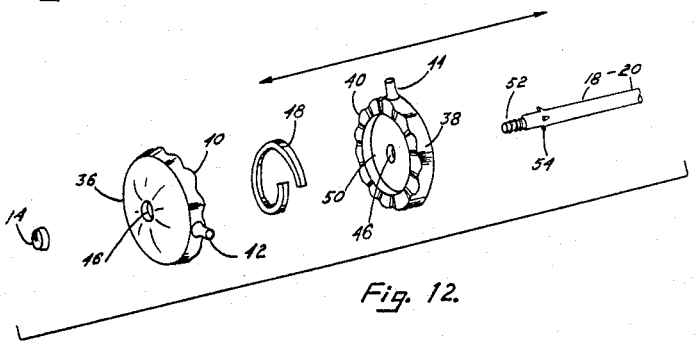
FIG. 12 illustrates the parts of the spring biased, cone-shaped corner hinge in an exploded drawing.

In an enlarged perspective drawing at FIG. 11, adjustable retention hinge 12 is shown assembled, and in an exploded view at FIG. 12, the hinge parts are illustrated. The numbered parts in these two figures include adjustable retention hinge 12, hinge adjust cap nut 14, a section of vertical support frame 16, a combination section illustration of top horizontal support shaft 18 and bottom horizontal support shaft 20, a section of bottom shade frame 22, outer hinge disc 36, inner hinge disc shade frame attach fitting 42, inner hinge disc support frame attach fitting 44, disc hinge shaft aperture 46, compression spring washer 48, compression spring washer hinge disc recess 50, threaded hinge adjust shaft 52; and shaft hinge housing stops 54. The names and numbers assigned the various parts indicate positioning and use and are shown assembled in FIG. 11. In FIG. 12, the hinge 12 parts are shown positioned for assembly.

In operation, compression spring washer 48 installed in compression spring washer hinge disc recess 50 applies release pressure against outer hinge disc 36 and inner hinge disc 38. This pressure allows force of contact between disc knurled contact surfaces 40 to be adjustably applied by turning hinge adjust cap nut 14 on threaded hinge adjust shaft 52 when the hinge parts of FIG. 12 are assembled as shown in FIG. 11.

Although I have described my invention with considerable details in the foregoing specification, it is to be understood that changes in the design and modifications in the structure may be practiced so long as the changes do not exceed the intended scope of the appended claims.

What is claimed is:

1. A toteable shaded headrest comprising:

a cloth covered frame work structured in three panel sections attached by adjustable hinging at converging corners in a manner to form a head shade panel, a support panel, and a base panel with said panels sufficiently sized for human head and shoulder coverage when said base panel is in a horizontal head rest position, said support panel is vertically inclined as a header, and said head shade panel is positioned in horizontal alignment with said base panel, there being manual means for tightening and loosening said adjustable hinging with said frame work structure being foldable into a carrying package with carrying handles affixed, there being multiple capped pouches in outwardly facing surfaces of said panels, and there being side extending flaps affixed to said shade panel for added shading and for a carrying package retainer when said frame work structure is folded, said shade panel and said side extending flaps affixed with cooperative means for attachment and detachment.

2. The toteable shaded headrest of claim 1 wherein said capped pouches are affixed with cap end retainers including buttons, button holes, and velcro attachment.

3. The toteable shaded headrest of claim 1 wherein said cooperative means for attachment and detachment of said side extending flaps and said shade panel includes buttons, button holes, and velcro attachment.

4. The toteable shaded headrest of claim 1 wherein said adjustable hinging at converging corners includes four double disc, spring biased, frictional positioned, conical hinges having manual adjustable end caps for tightening and loosening said double discs and the opposing surfaces of said double discs knurled for positive frictional retention when said manual adjustable end caps are tightened on threaded axle ends of transversing shade framework members extended centrally through said conical hinges as axles therefor.

5. The toteable shaded headrest of claim 1 wherein the shapes of said panel sections and the cloth covering thereon are restricted only by usage and said panels may assume a variety of shapes and said cloth covering includes variations in materials used and diversified patterns and colorings.

* * * * *